US007224316B2

(12) United States Patent
Ozkar et al.

(10) Patent No.: US 7,224,316 B2
(45) Date of Patent: May 29, 2007

(54) RETRACTABLE STUBBY ANTENNA

(75) Inventors: Mete Ozkar, Raleigh, NC (US); Gregory Poilasne, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 11/148,643

(22) Filed: Jun. 9, 2005

(65) Prior Publication Data

US 2006/0290577 A1 Dec. 28, 2006

(51) Int. Cl.
*H01Q 1/24* (2006.01)
*H01Q 1/12* (2006.01)

(52) U.S. Cl. ..... 343/702; 343/718

(58) Field of Classification Search ..... 343/702, 343/718

See application file for complete search history.

(56) References Cited

U.S. PATENT DOCUMENTS 4,868,576 A * 9/1989 Johnson, Jr. ..... 343/702
5,479,178 A * 12/1995 Ha ..... 343/702
5,583,520 A * 12/1996 Thill ..... 343/702
5,594,459 A * 1/1997 Hirota ..... 343/749
5,923,297 A * 7/1999 Kim et al. ..... 343/702
6,008,765 A * 12/1999 Davidson et al. ..... 343/702
6,052,089 A * 4/2000 Eggleston ..... 343/702
6,069,592 A * 5/2000 Wass ..... 343/895
6,075,489 A * 6/2000 Sullivan ..... 343/702
6,087,994 A * 7/2000 Lechter ..... 343/702
6,163,307 A * 12/2000 Kim et al. ..... 343/895
6,188,364 B1 * 2/2001 Scordilis ..... 343/702
6,269,240 B1 * 7/2001 Chong et al. ..... 455/73
6,310,578 B1 * 10/2001 Ying ..... 343/702
6,922,178 B2 * 7/2005 Sutter et al. ..... 343/895
2004/0027297 A1 * 2/2004 Chang ..... 343/702
2005/0184924 A1 * 8/2005 Fossett ..... 343/895

* cited by examiner

*Primary Examiner*—Don Wong
*Assistant Examiner*—Marie Antoinette Cabucos

(57) ABSTRACT

A retractable stubby antenna is movable relative to a housing along a longitudinal axis. In a retracted position, at least a portion of the retractable stubby antenna is positioned within the housing. In an extended position at least a portion of the retractable stubby antenna is positioned outside of the housing such that a greater portion of the antenna is positioned outside the housing in the extended positioned than in the retracted position. A radiating helical element is connected to device circuitry through a connection interface including an antenna interface and a housing connection interface.

5 Claims, 11 Drawing Sheets

RETRACTABLE STUBBY ANTENNA

BACKGROUND OF THE INVENTION

The invention relates in general to antennas and more specifically to a retractable stubby antenna.

Stubby antennas are often utilized in portable communication devices due to their compact design. Due to their structure, stubby antennas are typically shorter than antennas such as ¼ wave or ½ wave whip antennas. Accordingly, the use of a stubby antenna results in an overall smaller size of the portable communication device. Conventional portable communication devices, however, are limited in that position of the stubby antenna is a compromise between performance and size. Conventional stubby antennas are secured in a fixed position relative to the housing of the portable communication device. For example, stubby antennas utilized in conventional cellular telephones typically are secured to the housing such that at least a portion of the antenna is positioned outside the housing in order to increase antenna performance. Greater antenna performance is typically achieved when the antenna is positioned outside of the housing. Such a configuration, however, increases the size of device and results in a more cumbersome form factor. Although the size and form factor of the device may be improved by implementing the device with an internal stubby antenna, such a design results in a degradation of antenna performance. For many situations, the reduced performance does not significantly affect communication. In fringe areas and other situations where antenna performance is critical, however, the reduced antenna performance may not be adequate for communication.

DETAILED DESCRIPTION OF THE PREFERRED EMBODIMENTS

In accordance with exemplary embodiments of the invention, a retractable stubby antenna is movable relative to a housing along a longitudinal axis. In a retracted position, at least a portion of the retractable stubby antenna is positioned within the housing. In an extended position, at least a portion of the retractable stubby antenna is positioned outside of the housing such that a greater portion of the antenna is positioned outside the housing in the extended positioned than in the retracted position. A radiating helical element is connected to device circuitry through a connection interface including an antenna connection interface and a housing connection interface. As explained below with reference to the exemplary embodiments, the connection interface may have any of several configurations and provides the electrical connection at least when the antenna is in the retracted position and when the antenna is in the extended position.

Figure 1:
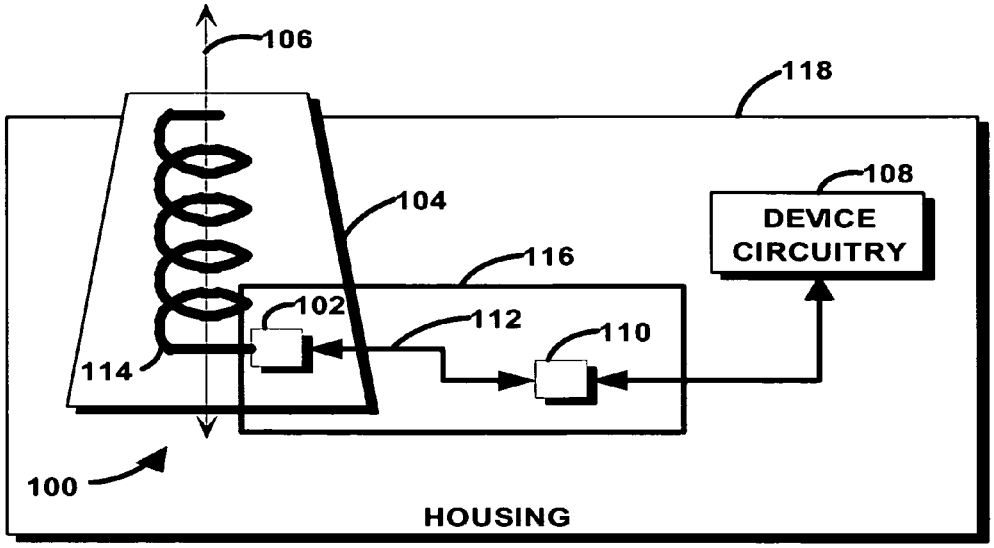
FIG. 1 is a block diagram of a retractable stubby antenna device within a housing when the antenna is in a retracted position in accordance with the exemplary embodiments of the invention.
Figure 2:
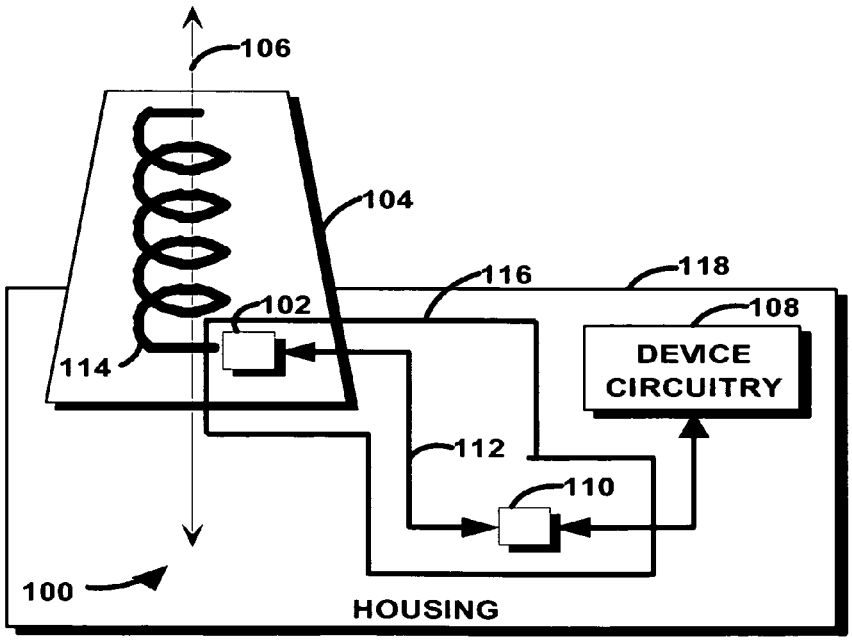
FIG. 2 is a block diagram of the retractable stubby antenna device within the housing when the antenna is in an extended position in accordance with the exemplary embodiments of the invention.

FIG. 1 and FIG. 2 are block diagrams of side views of a retractable stubby antenna 102 within a housing 118 in accordance with the exemplary embodiments of the invention. The blocks in FIG. 1 and FIG. 2 generally represent exemplary relative configurations of the retractable stubby antenna ("antenna") 104 in a retracted position and extended position, respectively, and do not necessarily represent relative sizes or positions of the components illustrated. In the exemplary embodiments, the antenna 104 is implemented as part of a mobile communication device such as, for example, a cellular telephone or wireless PDA. The housing 118 in the exemplary embodiment, is the housing of the portable communication device. The retractable stubby antenna 104 is movable along a longitudinal axis 106 relative to the mobile communication device housing 118 and can be retracted or extended relative to the housing 118.

A connection interface 116 connects device circuitry 108 to a helical radiating element 114. In the exemplary embodiments, the connection interface 116 includes an antenna connection interface 102 that engages a housing connection interface 110 to provide an electrical connection 112 between the helical radiating element 114 and the device circuitry 108 at least when the antenna is in a retracted position and when the antenna 104 is in an extended position. As explained below in further detail, the antenna connection interface 102, as well as the housing connection interface 110, may include a single connection contact or multiple connection contacts where the single contact may provide an electrical connection between the device circuitry 108 and the helical radiating assembly in more than one antenna position.

The helical radiating element 114 may be formed using any of several techniques. An example of a suitable helical radiating element 114 includes a coiled conductor wrapped around a core material such as dielectric material or plastic. In some circumstances, the core material may be omitted. In the first and second exemplary embodiments discussed below with reference to FIG. 12, FIG. 13, FIG. 14, FIG. 15, FIG. 16 and FIG. 17, the helical radiating element 114 includes a flex circuit having a conductor arranged in configuration resulting in an antenna having similar properties to a helix conductor.

The retractable stubby antenna 102 remains in the retracted position during situations when antenna performance in not critical and adequate transmission and reception can be achieved with the antenna 104 in the retracted position. The antenna 104 is extended into the extended position when additional performance is required or the user anticipates that additional antenna performance may be required. In the retracted position, at least a portion of the antenna 104 is positioned within the housing 118. In the extended position, at least a portion of the antenna 104 is positioned outside the housing 118 where a greater portion of the antenna 104 is positioned outside the housing in the extended position than in the retracted position.

In the exemplary embodiments, a user extends and retracts the retractable stubby antenna 102 by grasping and moving the antenna relative to the housing 100. The antenna 102 slideably moves along an attachment mechanism (not shown). The attachment mechanism is any mechanical configuration that allows the antenna to be moved along the longitudinal axis 106 and depends on the particular antenna implementation. An example of a suitable attachment mechanism includes a sleeve surrounding the antenna 102 that relies on friction between the inner part of the sleeve and at least a portion of the antenna 104 to secure the antenna 104 in the extended and retracted positions. Another example includes a shaft that extends through an opening within the interior of the antenna 102 that utilizes friction forces to maintain the antenna in the positions. The attachment mechanism may be part of, or separate from the connection interface 116.

In some circumstances, matching and tuning circuits are used to increase the performance of the antenna 104 in one or more of the antenna positions. Tuning brackets as well and discrete matching components may be used to change characteristics of the device, ground or other factors affecting performance. For example, tuning elements techniques may be used to optimize the antenna 104 in the various positions due to impedance variations resulting from changes in proximity and relative position of other device components or changes in connection interface 116 characteristics.

Figure 3:
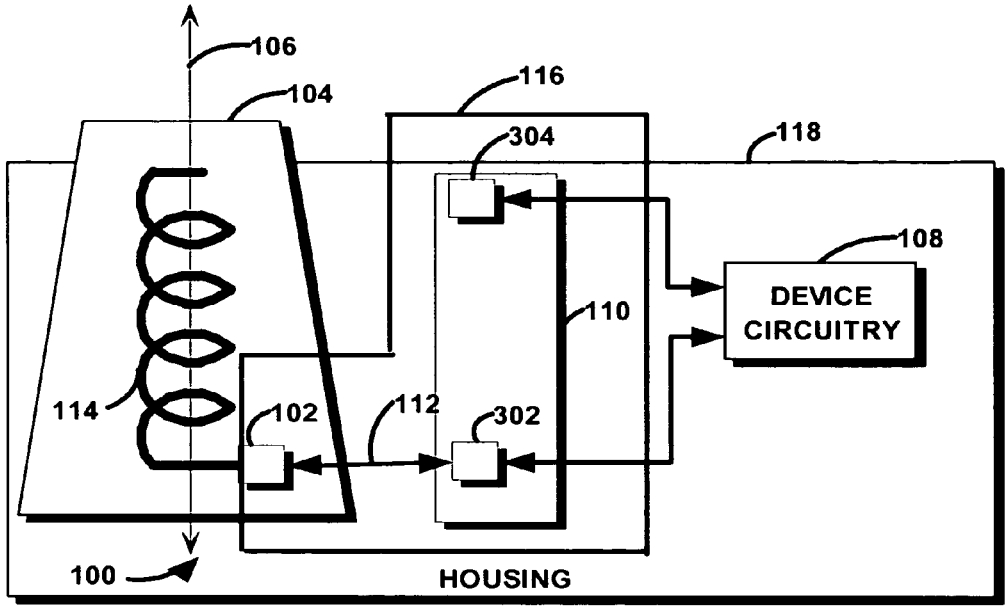
FIG. 3 is a block diagram of the retractable stubby antenna device within the housing when the antenna is in the retracted position in accordance with exemplary embodiments of the invention where the housing connection interface comprises a plurality of connectors.
Figure 4:
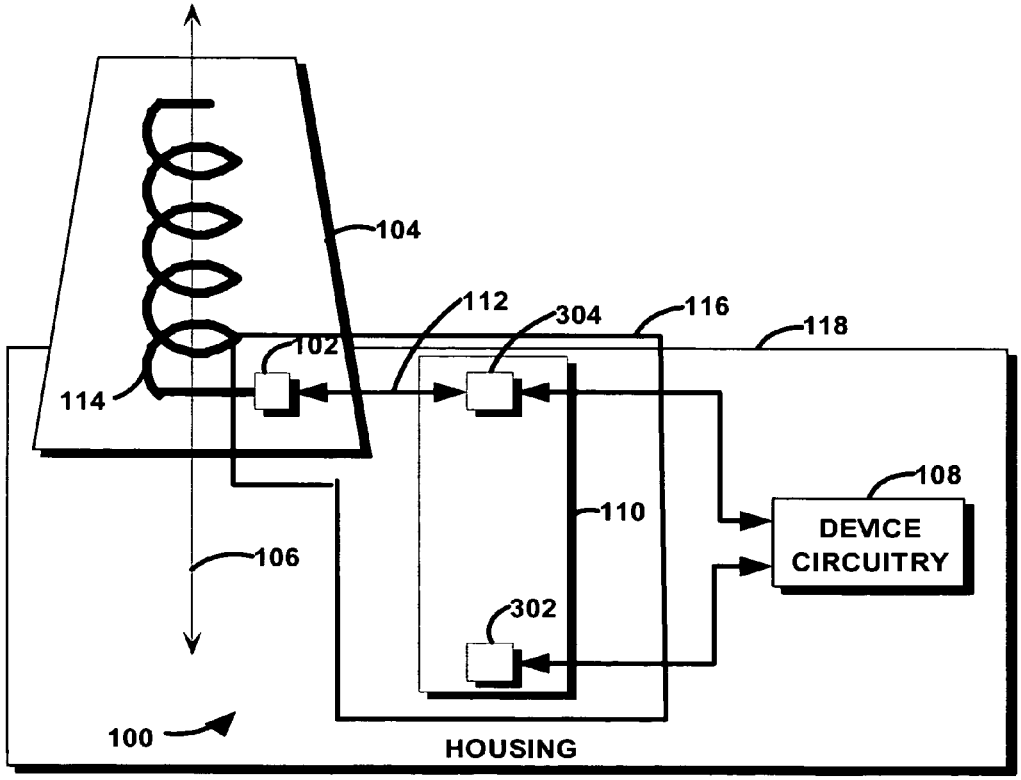
FIG. 4 is a block diagram of the retractable stubby antenna device within the housing when the antenna is in the extended position in accordance with exemplary embodiments of the invention where the housing connection interface comprises a plurality of connectors.

FIG. 3 and FIG. 4 are block diagrams of side views of the retractable stubby antenna 104 in accordance with exemplary embodiments of the invention where the antenna connection interface 102 includes a single contact and the housing connection interface 110 includes a plurality of contacts 302-304. In FIG. 3, the antenna 104 is in the retracted position and in FIG. 4, the antenna 104 is in the extended position. A lower housing contact 302 engages the single contact 102 when the antenna 104 is in the retracted position to form the electrical connection 112 between the helical radiating element 114 and the device circuitry 108. An upper housing contact 304 engages the single contact 102 when the antenna 104 is in the extended position to form the electrical connection 112 between the helical radiating element 114 and the device circuitry 108. Accordingly, in the exemplary embodiments discussed with reference to FIG. 3 and FIG. 4, the lower housing contact 302 is positioned within the housing 118 further from the top of the antenna 104 than the upper housing connection 304. Additional contacts may be included between the upper housing contact 304 and the lower housing contact 302 in some circumstances to provide the electrical connection 112 in antenna positions other than the fully retracted position and fully extended position.

Figure 5:
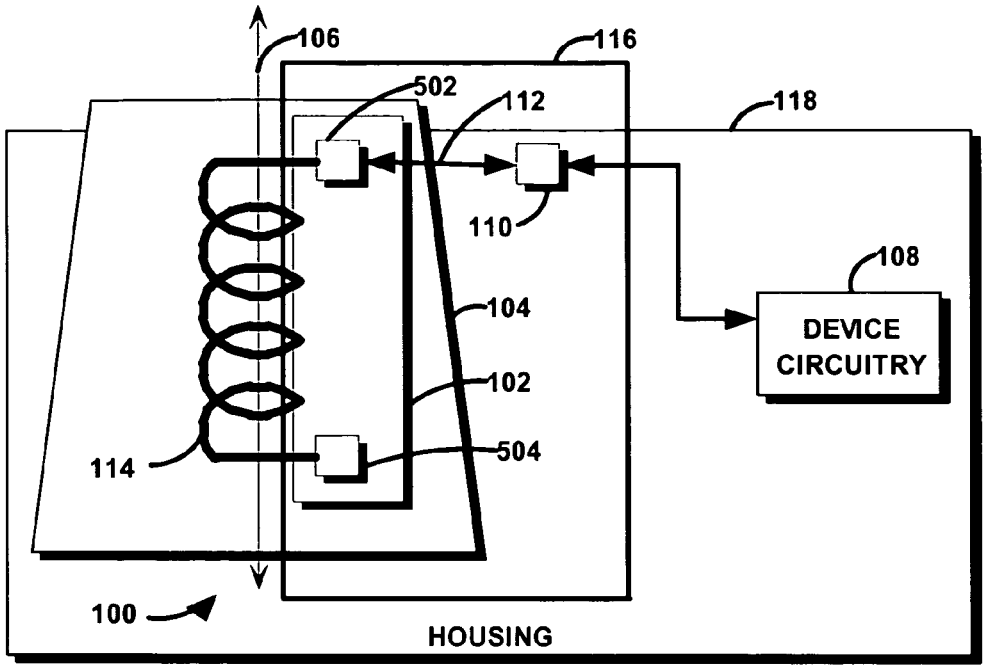
FIG. 5 is a block diagram of the retractable stubby antenna device within the housing when the antenna is in the retracted position in accordance with exemplary embodiments of the invention where the antenna connection interface comprises a plurality of connectors.
Figure 6:
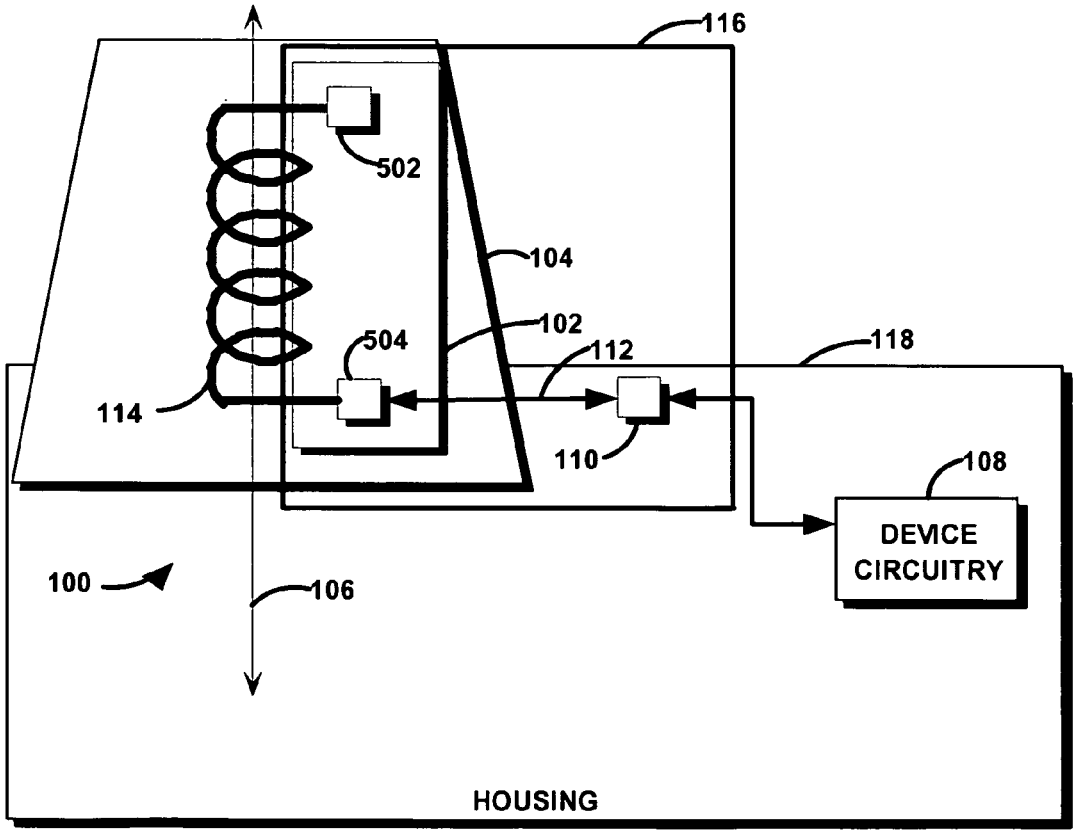
FIG. 6 is a block diagram of the retractable stubby antenna device within the housing when the antenna is in the extended position in accordance with exemplary embodiments of the invention where the antenna connection interface comprises a plurality of connectors.

FIG. 5 and FIG. 6 are block diagrams of side views of the retractable stubby antenna 104 in accordance with exemplary embodiments of the invention where the antenna connection interface 102 includes a plurality of contacts 502-504 and the housing interface 110 includes a single contact. In FIG. 5, the antenna 104 is in the retracted position and in FIG. 6, the antenna 104 is in the extended position. A top antenna contact 502 engages the single contact 110 when the antenna 104 is in the retracted position to form the electrical connection 112 between the helical radiating element 114 and the device circuitry 108. A base antenna contact 504 engages the single contact 110 when the antenna 104 is in the extended position to form the electrical connection 112 between the helical radiating element 114 and the device circuitry 108. Additional contacts may be included between the top antenna contact 502 and the base antenna contact 504 in some circumstances to provide the electrical connection 112 in antenna positions other than the fully retracted position and fully extended position.

Figure 7:
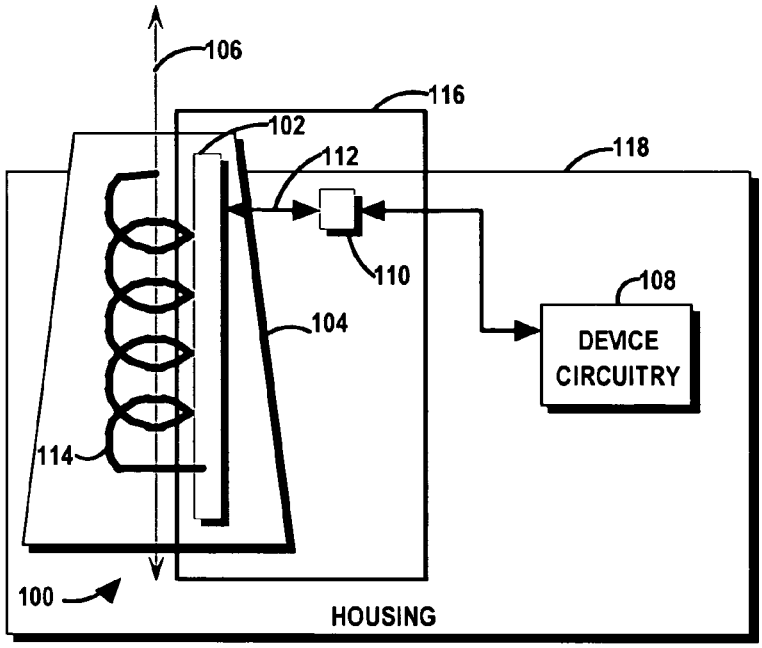
FIG. 7 is a block diagram of the retractable stubby antenna device within the housing when the antenna is in the retracted position in accordance with exemplary embodiments of the invention where the antenna connection interface comprises a single continuous connector.
Figure 8:
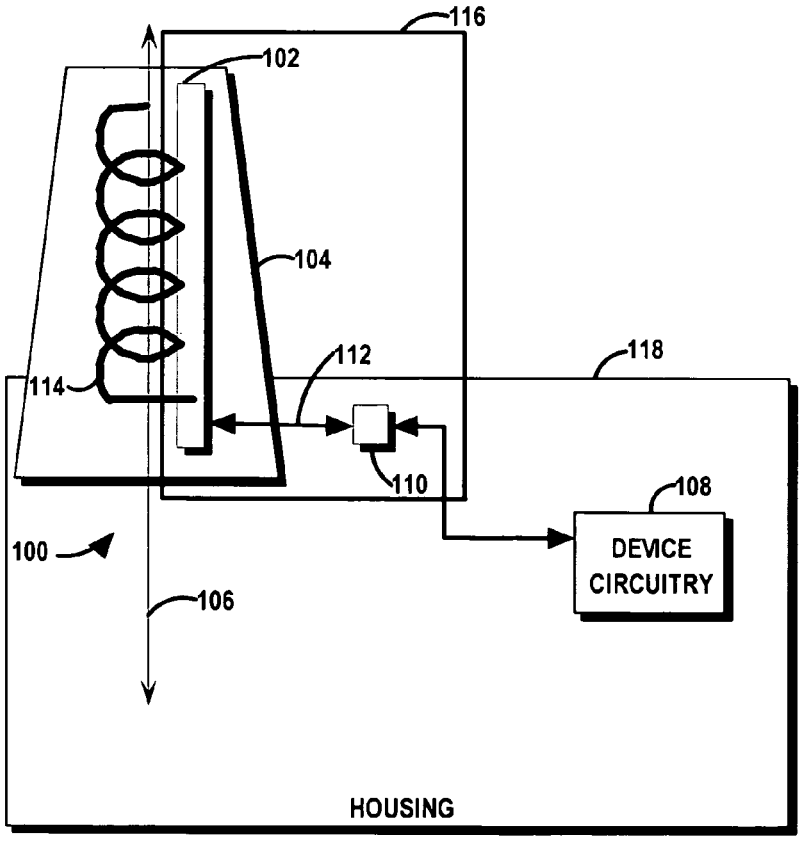
FIG. 8 is a block diagram of the retractable stubby antenna device within the housing when the antenna is in the extended position in accordance with exemplary embodiments of the invention where the antenna connection interface comprises a single continuous connector.

FIG. 7 and FIG. 8 are block diagrams of side views of the retractable stubby antenna 104 in accordance with exemplary embodiments of the invention where the connection interface 102 is a single continuous contact and the housing connection interface 110 includes a single contact. In FIG. 7, the antenna 104 is in the retracted position and in FIG. 8, the antenna 104 is in the extended position. The continuous contact continuously provides the electrical connection 112 between the helical radiating element 114 and the device circuitry as the antenna is moved along the longitudinal axis 106 of the antenna 104 relative to the housing 118. Any of several configurations may be used to form a connection interface 116 that allows the electrical connection to be maintained as the antenna 104 is extended and retracted. In a first exemplary embodiment discussed with reference to FIG. 11, FIG. 12, FIG. 13, FIG. 14, FIG. 15 and FIG. 16, a section of flex circuit conductor is positioned within a slot of a core and is contacted by a spring connector of the housing connection interface 110. In a second embodiment discussed with reference to FIG. 17, a ball contact of the housing connection interface 110 slideably contacts the inside of a conductive tube positioned within the center of the core.

Other configurations of the antenna connection interface 104 may be used in some circumstances. Combinations and modifications of the configurations discussed above may result in other useful antennas 104. For example, connection interface 116 may include an antenna connection interface 102 having a single connector that engages a continuous single connector of the housing connector interface 110 to provide a continuous electrical connection 112 while the antenna 104 is moved between the fully retracted and fully extended positions.

FIG. 9, FIG. 10, FIG. 11 and FIG. 12 are illustrations of perspective views of flex circuit conductors 900, 1000, 1100, 1200, of retractable stubby antennas 104 formed with flex circuits applied to a core. The flex circuit portion 900 includes a conductor arranged in a pattern such that the helical radiating element 114 is formed when the flex circuit is applied to a core. In the interest of clarity, the core is not shown in FIG. 9, FIG. 10, FIG. 11 and FIG. 12. The structure formed by the flex circuit has antenna properties similar to a stubby antenna having a helix coil although the helical radiating elements 114 formed by the flex circuit conductors can also be characterized as a meander line radiating element in some situations. The stubby antennas 104 formed by the flex circuit conductors 900, 1000, 1100, 1200 may include other mechanisms, connectors, and insulators not shown in the figures. For example, a casing, covering, or other protective coating may be applied over the helical radiating element 114 in some circumstances to improve durability and aesthetics.

Figure 9:
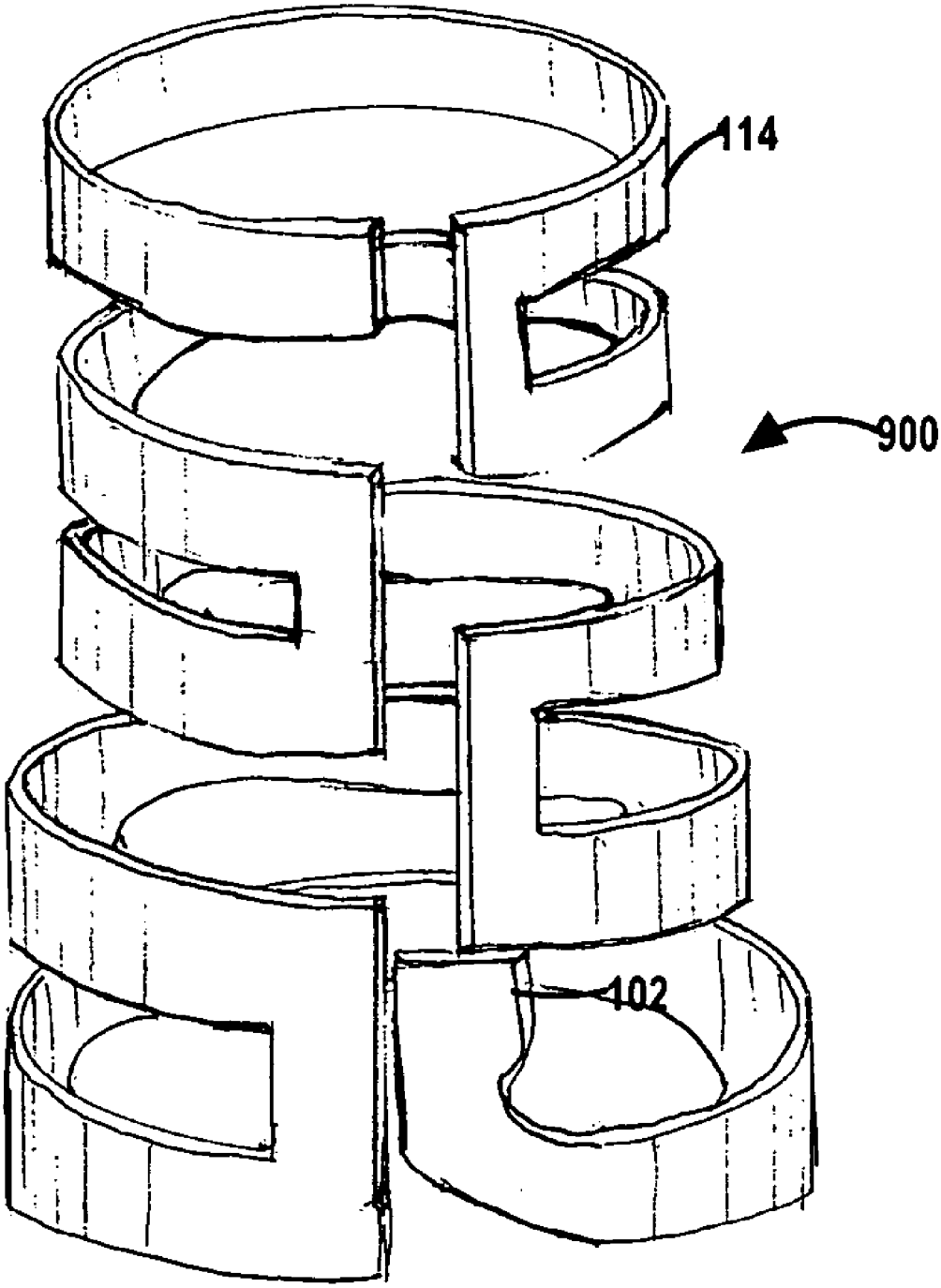
FIG. 9 is an illustration of a perspective view of a flex circuit conductor where the antenna connection interface includes a single base connector.

FIG. 9 is an illustration of a perspective view of the flex circuit conductor 900 where the antenna connection interface 102 includes a single base connector. The antenna 104 formed with the flex circuit conductor may be used in implementation shown in FIG. 3 and FIG. 4 as well as in an implementation where the housing interface 110 includes a single continuous connector extending though the center of the antenna 104.

Figure 10:
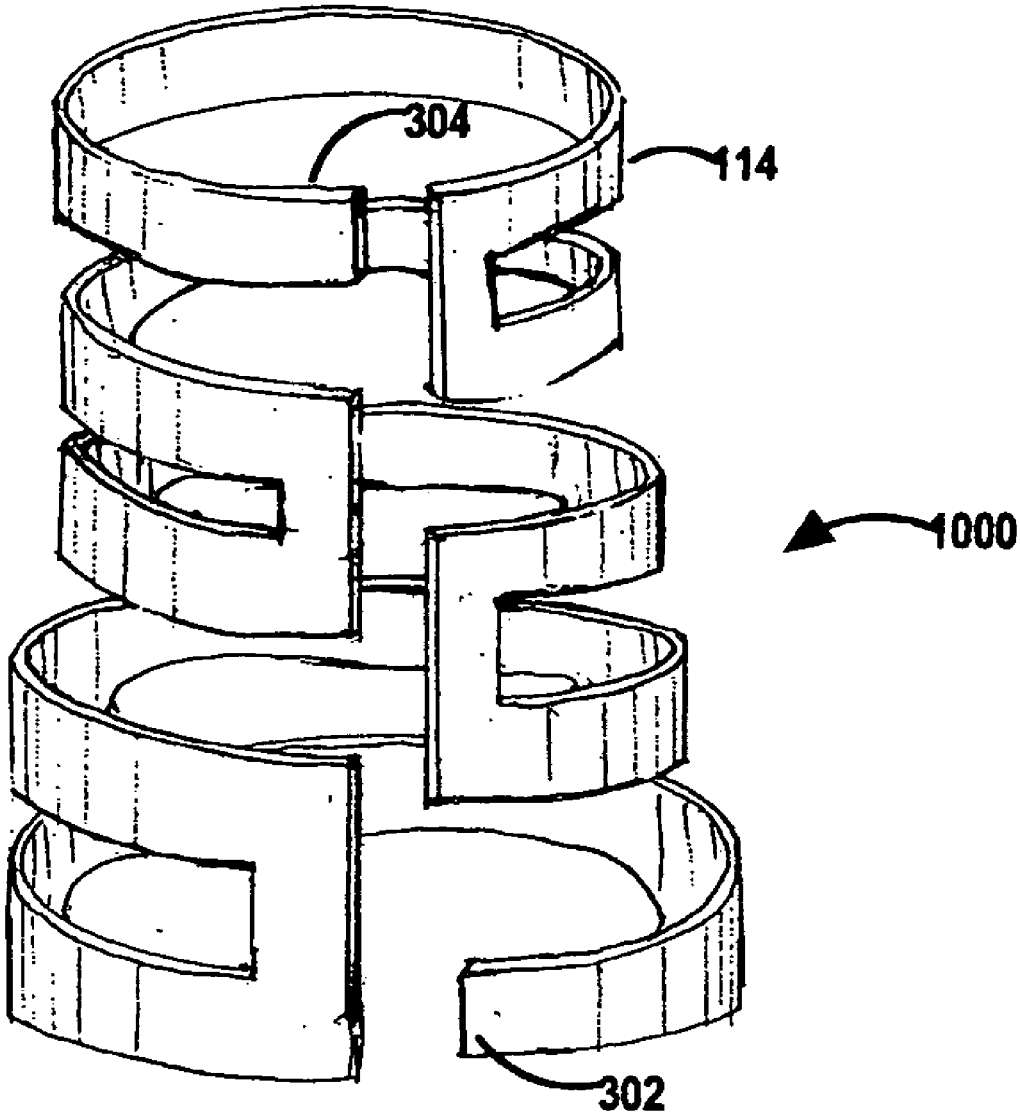
FIG. 10 is an illustration of a perspective view of a flex circuit conductor where the antenna connection interface includes a top connector and a single base connector.

FIG. 10 is an illustration of a perspective view of a flex circuit conductor 1000 where the antenna 104 where the antenna interface conductor 102 includes a top connector 304 and a base connector 302. The antenna 104 formed with the flex circuit conductor may be used in implementation shown in FIG. 3 and FIG. 4 as well as in the implementation shown in FIG. 5 and FIG. 6. For example, where only the top connector 304 or only the base connector 302 is used, a housing connection interface 110 may include a two or more connectors to connect to the single contact in the antenna positions. Where both the top connector 304 and the base connector 302 are used during operation, the housing interface connector 110 may include only a single connector.

Figure 11:
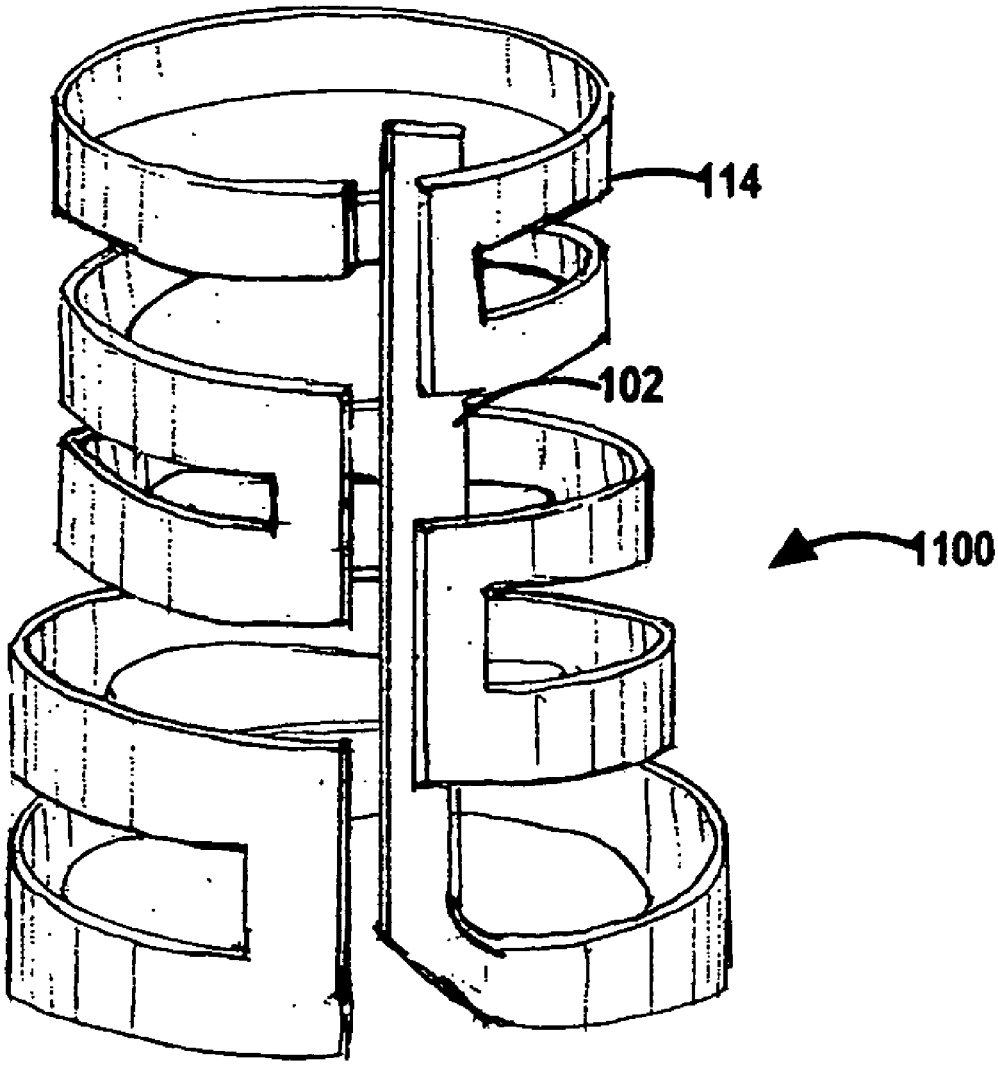
FIG. 11 is an illustration of a perspective view of the flex circuit conductor where the antenna connection interface includes a single continuous connector.

FIG. 11 is an illustration of a perspective view of a flex circuit conductor 1100 where the antenna connection interface 102 includes a single continuous connector. The antenna 104 formed with the flex circuit conductor may be used in implementation shown in FIG. 7 and FIG. 8 to provide a continuous electrical connection 112 as the antenna 104 is moved relative to the housing 118.

Figure 12:
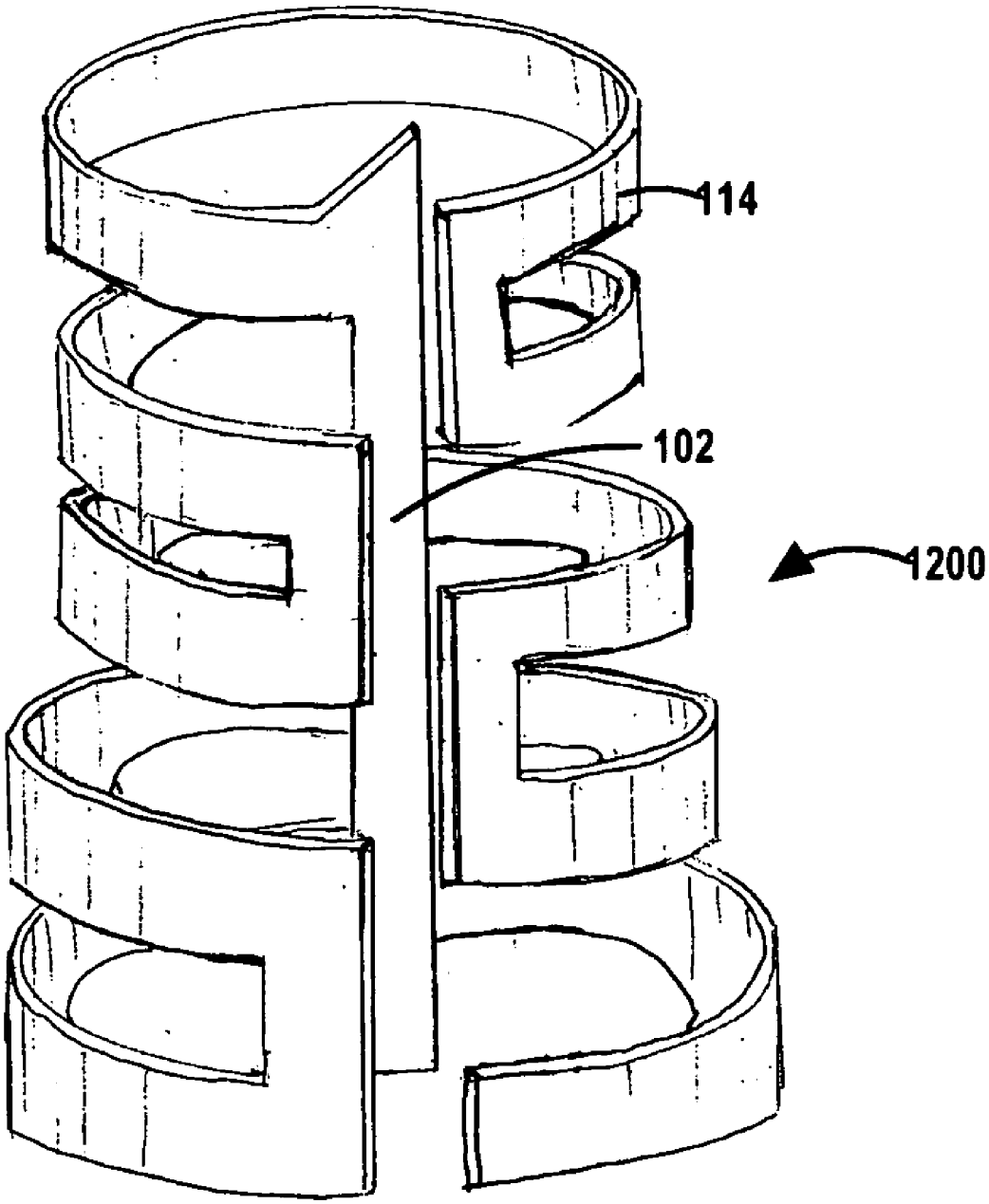
FIG. 12 is an illustration of a perspective view of the flex circuit conductor where the antenna connection interface includes a single continuous connector connected to the helical radiating element at the top of the antenna.

FIG. 12 is an illustration of a perspective view of the flex circuit conductor 1200 in accordance with the first exemplary embodiment where the antenna connection interface 102 includes a single continuous connector connected at a top of the antenna 104. The antenna 104 formed with the flex circuit conductor may be used in implementation shown in FIG. 7 and FIG. 8 to provide a continuous electrical connection 112 as the antenna 104 is moved relative to the housing 118.

Figure 13:
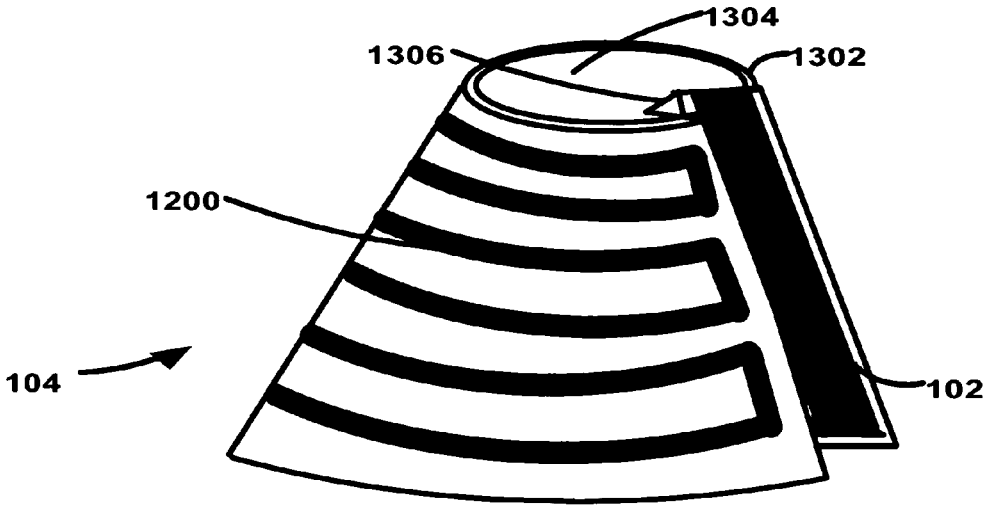
FIG. 13 is an illustration of a perspective view of the antenna in accordance with a first exemplary embodiment including a flex circuit and a core with a slot.
Figure 14:
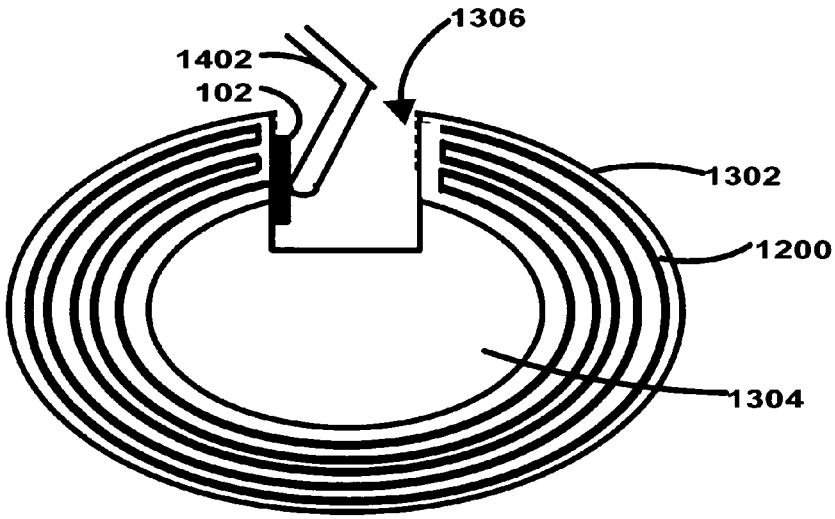
FIG. 14 is an illustration of a top view of the antenna in accordance with the first exemplary embodiment.

FIG. 13 is an illustration of a perspective view and FIG. 14 is an illustration of a top view of the exemplary antenna 104 where a flex circuit conductor 1200 of a flex circuit 1302 is applied to a core 1304 to form a helical radiating element 114 in accordance with a first exemplary embodiment. The continuous contact of the antenna connection interface 102 is positioned within a slot 1306 of the core 1304. In the first exemplary embodiment, the housing connection interface 110 includes a spring contact 1402 that is positioned within the slot 1306 and adjacent to the antenna connection interface 102. Tension forces, therefore, push the spring contact against the antenna connection interface to maintain the electrical connection 112. Therefore, in the first exemplary embodiment, the section of conductor on the inside of the slot 1306 is a continuous contact that forms the antenna connection interface 102 and the spring contact 1402 forms the housing connection interface 110.

Figure 15:
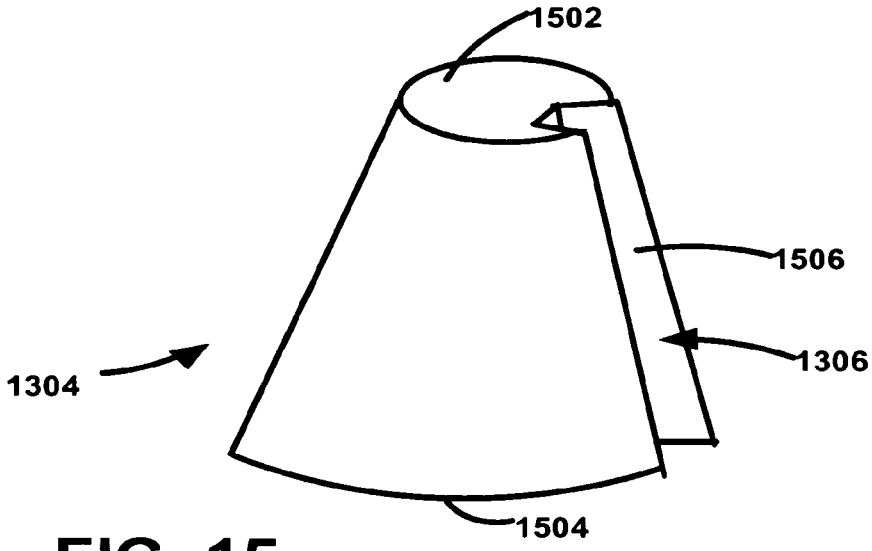
FIG. 15 is an illustration of a perspective view of the core in accordance with the first exemplary embodiment.

FIG. 15 is an illustration of a core 1304 having a slot 1306 in accordance with the first exemplary embodiment of the invention. Although other materials may be used, the core 1304 is formed from plastic in the first and second exemplary embodiments. The core 1304 has tapered structure with a substantially flat and parallel top 1502 and bottom 1504 forming a conical configuration. An inside edge 1506 of the slot 1306 is provides a surface for applying the section of conductor of the flex circuit that forms the antenna connection interface 102.

Figure 16:
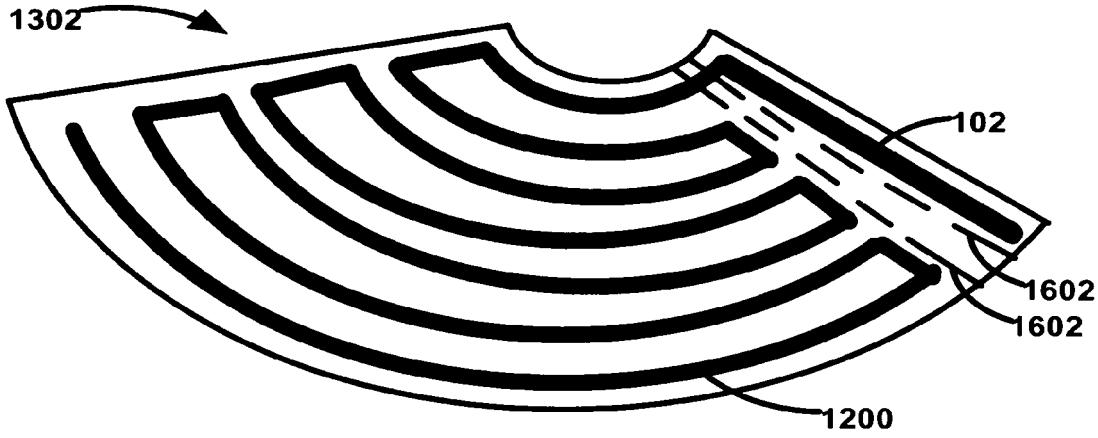
FIG. 16 is an illustration of a top view of the flex circuit before application to the core in accordance with the first exemplary embodiment.

FIG. 16 is an illustration of a top view a flex circuit 1302 including the flex circuit conductor 1200 arranged in a pattern that forms a helical conductor when applied to the core 1304. The shape and size of the flex circuit 1302 allow the flex circuit to be wrapped around conical core 1304 such that the flex circuit conductor forms the helical radiation element 114. The flex circuit is folded along fold lines 1602 such that the section of conductor is positioned along the inside edge 1506 of the slot 1306.

Figure 17:
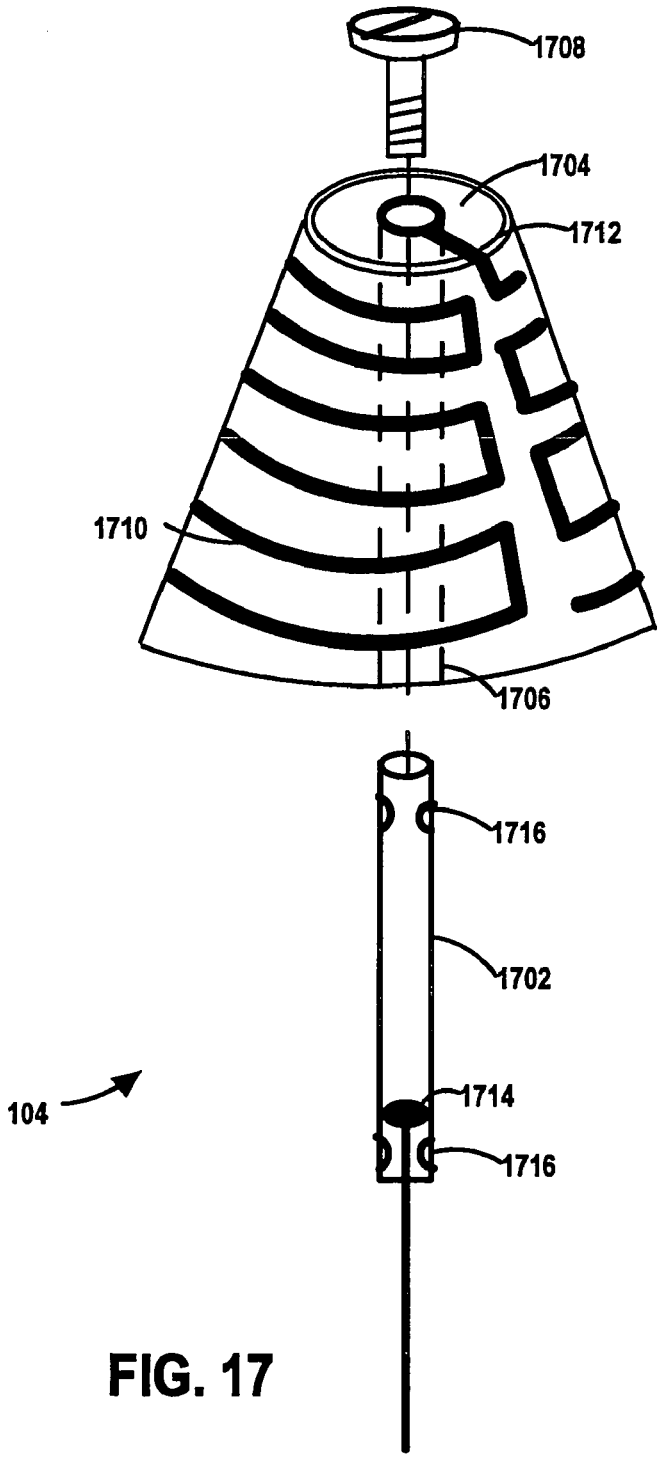
FIG. 17 is an illustration of an exploded view of an antenna in accordance with a second exemplary embodiment where the core includes a conductive tube.

FIG. 17 is an illustration of an exploded view of the antenna in accordance with the second exemplary embodiment of the invention where the single continuous connector of the antenna connection interface 102 is a conductive tube 1702 within the center of a core 1704. The conductive tube 1702 fits into circular channel 1706 within the core 1704. A screw 1708 threaded into the conductive tube 1702 secures the conductive tube 1702 to the core 1704 and provides an electrical connection between the flex circuit conductor 1710 of the flex circuit 1712 and the conductive tube 1702. A ball contact 1714 of the housing connection interface 110 snugly moves within the conductive tube 1702 as the antenna 104 is moved along the longitudinal axis 106 relative to the housing 118. Positioning bumps 1716 within the conductive tube 1702 provide a mechanism for holding the antenna 104 in the retracted position and the extended position.

Therefore, the exemplary retractable stubby antennas 104 include connection interfaces 116 that provide an electrical connection between the helical radiating element 114 and circuitry 108 within the portable communication device at least when the antenna 104 is in the retracted position and the extended position. In some embodiments, the electrical connection 112 is continuous as the antenna 104 is moved relative to the housing 118. The antenna 104 is placed in the retracted position to minimize size of the portable device but can be extended to improve antenna performance.

Clearly, other embodiments and modifications of this invention will occur readily to those of ordinary skill in the art in view of these teachings. The above description is illustrative and not restrictive. This invention is to be limited only by the following claims, which include all such embodiments and modifications when viewed in conjunction with the above specification and accompanying drawings. The scope of the invention should, therefore, be determined not with reference to the above description, but instead should be determined with reference to the appended claims along with their full scope of equivalents.

What is claimed is:

1. A retractable stubby antenna device comprising:

a housing comprising a housing connection interface;

a retractable stubby antenna moveable relative to the housing along a longitudinal axis of the retractable stubby antenna and comprising:

a flex circuit having a flex circuit conductor forming a helical radiating element;

a conductive tube connected to the helical radiating element and configured to slideably receive the housing connection interface to form an electrical connection between the housing connection interface and the flex circuit at least when the retractable stubby antenna is in a retracted position where at least a portion of the retractable stubby antenna is within the housing and when in the retractable stubby antenna is in an extended position where a greater portion of the retractable stubby antenna is outside the housing than when in the retracted position.

2. A retractable stubby antenna device in accordance with claim 1, further comprising a core, the flex circuit applied to an outer surface of the core.

3. A retractable stubby antenna device in accordance with claim 2, wherein the conductive tube is positioned within a channel of the core extending along the longitudinal axis of the antenna.

4. A retractable stubby antenna device in accordance with claim 1, wherein the housing interface connection comprises a ball contact slideably positioned within the conductive tube.

5. A portable communication device comprising:

a housing comprising a housing connection interface;

device circuitry situated within the housing;

a retractable stubby antenna moveable relative to the housing along a longitudinal axis of the retractable stubby antenna and comprising:

a flex circuit having a flex circuit conductor forming a helical radiating element:

a conductive tube connected to the helical radiating element and configured to slideably receive the housing connection interface to form an electrical connection between the housing connection interface and the flex circuit at least when the retractable stubby antenna is in a retracted position where at least a portion of the retractable stubby antenna is within the housing and when in the retractable stubby antenna is in an extended position where a greater portion of the retractable stubby antenna is outside the housing than when in the retracted position.

* * * * *